US011149544B2

(12) United States Patent
Deville et al.

(10) Patent No.: US 11,149,544 B2
(45) Date of Patent: Oct. 19, 2021

(54) COMBINED TELEMETRY AND CONTROL SYSTEM FOR SUBSEA APPLICATIONS

(71) Applicant: Schlumberger Technology Corporation, Sugar Land, TX (US)

(72) Inventors: Benoit Deville, Houston, TX (US); Arnaud Croux, Boston, MA (US); Stephane Vannuffelen, Cambridge, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/471,216

(22) PCT Filed: Dec. 19, 2016

(86) PCT No.: PCT/US2016/067413
§ 371 (c)(1),
(2) Date: Jun. 19, 2019

(87) PCT Pub. No.: WO2018/117998
PCT Pub. Date: Jun. 28, 2018

(65) Prior Publication Data
US 2020/0116017 A1 Apr. 16, 2020

(51) Int. Cl.
*E21B 47/16* (2006.01)
*E21B 33/06* (2006.01)
*E21B 33/064* (2006.01)

(52) U.S. Cl.
CPC ..... *E21B 47/16* (2013.01); *E21B 33/061* (2013.01); *E21B 33/064* (2013.01)

(58) Field of Classification Search
CPC ..... E21B 47/16; E21B 33/061; E21B 33/064
(Continued)

(56) References Cited

U.S. PATENT DOCUMENTS 8,994,550 B2 3/2015 Millot et al.
2006/0065401 A1* 3/2006 Allen ..... E21B 44/00 166/345
(Continued)

FOREIGN PATENT DOCUMENTS

WO 2010020354 A1 2/2010
WO WO-2010020354 A1 * 2/2010 ..... E21B 47/122

OTHER PUBLICATIONS

International Preliminary Report on Patentability issued in the related PCT Application PCT/US2016/067413, dated Jun. 25, 2019 (13 pages).
(Continued)

*Primary Examiner* — Matthew R Buck
*Assistant Examiner* — Patrick F Lambe

(57) ABSTRACT

A technique facilitates communication in a subsea well application. The technique involves deployment of a blowout preventer subsea control and telemetry system to a subsea location proximate a wellbore. The blowout preventer subsea control and telemetry system is coupled to both a blowout preventer system and a wireless telemetry system. The wireless telemetry system has a plurality of repeaters deployed along the wellbore. The blowout preventer subsea control and telemetry system is used both to collect data from the wireless telemetry system and to control operation of the blowout preventer system. For example, the blowout preventer subsea control and telemetry system may receive control signals from a surface system and also relay data to the surface system through a common communication line.

20 Claims, 8 Drawing Sheets

(58) Field of Classification Search
USPC ..... 166/336
See application file for complete search history.

(56) References Cited

U.S. PATENT DOCUMENTS

| | | | |
|---|---|---|---|
| 2007/0000667 | A1 | 1/2007 | MacKenzie et al. |
| 2012/0126992 | A1 | 5/2012 | Rodney et al. |
| 2013/0083627 | A1 | 4/2013 | Yates |
| 2013/0335232 | A1 | 12/2013 | Conway et al. |

OTHER PUBLICATIONS

International Search Report and Written Opinion issued in the related PCT Application PCT/US2016/067413, dated Sep. 7, 2017 (14 pages).

* cited by examiner

COMBINED TELEMETRY AND CONTROL SYSTEM FOR SUBSEA APPLICATIONS

BACKGROUND

This invention is related to the field subsea control and telemetry, and, more particularly, to a blowout preventer and telemetry system.

DESCRIPTION OF THE RELATED ART

In many hydrocarbon well applications, a wellbore is drilled into a desired hydrocarbon-bearing formation at a subsea location. A blowout preventer system may be positioned over the wellbore at the subsea location and may comprise a plurality of rams and other features controlled at least in part by a surface control system. A well string, e.g. a drill string, may be deployed through the blowout preventer system and into the wellbore for performance of the desired drilling or other downhole operation. In some applications, various sensors are deployed downhole and a telemetry system is used to convey data to the seabed. The use of separate control systems and separate dedicated control lines, e.g. an umbilical and a separate control line cable, routed from the subsea location to surface control systems can add expense and complexity to a given subsea operation.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

In general, a methodology and system involve deployment of a blowout preventer (BOP) subsea control and telemetry system to a subsea location proximate a wellbore. The BOP subsea control and telemetry system is coupled to both a blowout preventer system and a wireless telemetry system. The wireless telemetry system has a plurality of repeaters, e.g. acoustic signal repeaters, deployed along the wellbore. The BOP subsea control and telemetry system is used both to collect data from the wireless telemetry system and to control operation of the blowout preventer system. For example, the BOP subsea control and telemetry system may receive control signals from a surface system and also relay data to the surface system through a common communication line.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
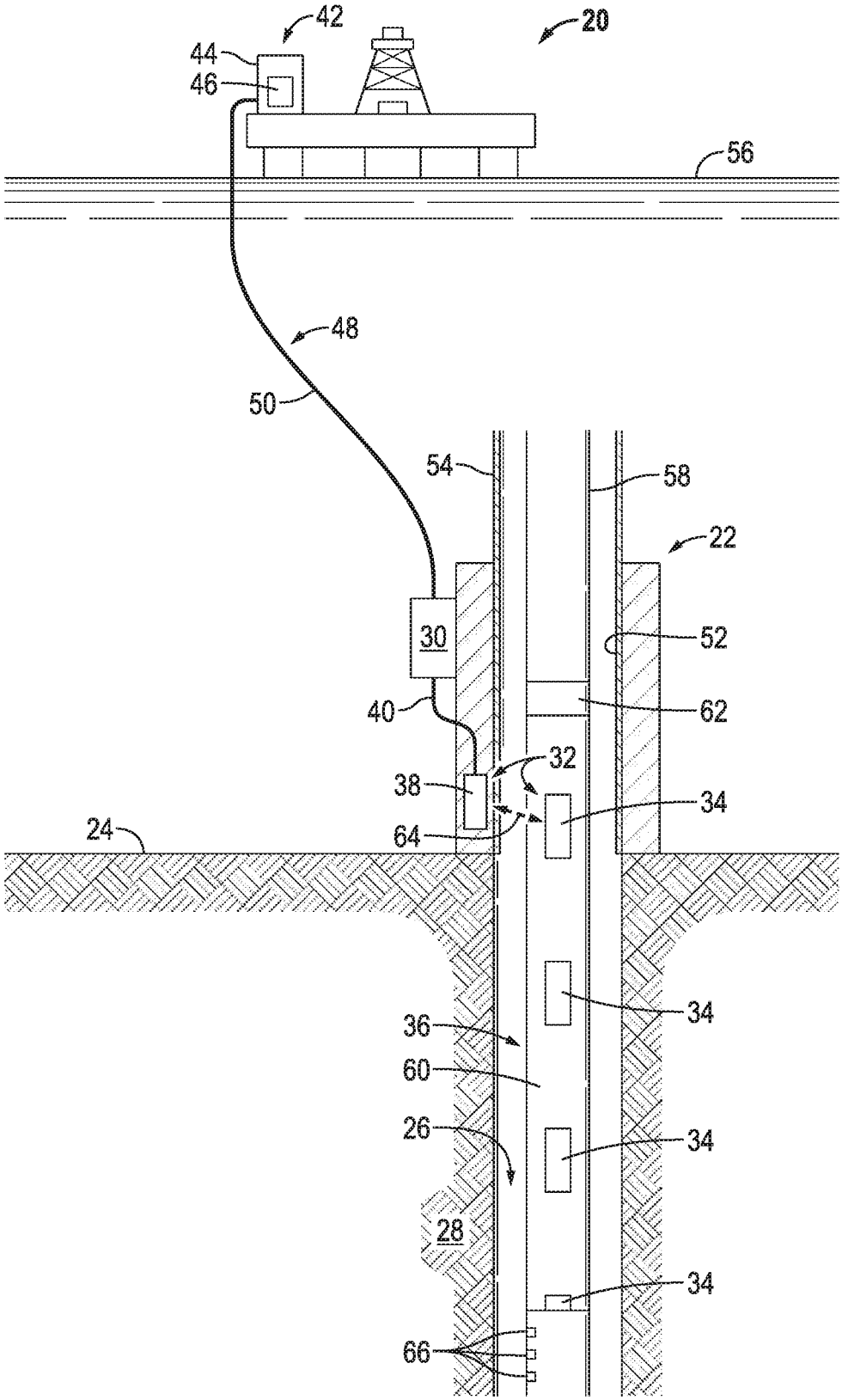
FIG. 1 is a schematic illustration of an example of a subsea well system having a blowout preventer system and a wireless telemetry system, according to an embodiment of the disclosure.

It is to be understood that the present disclosure provides many different embodiments, or examples, for implementing different features of various embodiments. Specific examples of components and arrangements are described below for purposes of explanation and to simplify the present disclosure. These are, of course, merely examples and are not intended to be limiting.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not mandate any particular orientation of the components.

In the specification and appended claims: the terms "connect," "connection," "connected," "in connection with," and "connecting" are used to mean "in direct connection with" or "in connection with via one or more elements;" and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "upper" and "lower," "upwardly" and downwardly," "upstream" and "downstream;" "above" and "below;" and other like terms indicating relative positions above or below a given point or element are used in this description to more clearly describe some embodiments of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

With respect to certain embodiments of the present disclosure, a system and methodology are provided which facilitate communication of signals, e.g. data and control signals, between subsea systems and a surface control. The system and methodology enable the desired communication in subsea applications with substantially reduced expense and complexity. For example, a subsea control and telemetry system may be used to receive and transmit various signals, such as control signals and data signals. In some applications, the data signals may comprise sensor data relayed to the subsea control and telemetry system via a telemetry system, e.g. a wireless telemetry system, deployed along a wellbore. The control signals may comprise signals sent from a surface control regarding operation of, for example, a hydraulic actuation system used to control rams and other features of a blowout preventer system.

According to an embodiment, a BOP subsea control and telemetry system is deployed to a subsea location proximate a wellbore. The BOP subsea control and telemetry system is coupled to both a blowout preventer system and a wireless telemetry system. The wireless telemetry system has a plurality of repeaters, e.g. acoustic signal repeaters, deployed along the wellbore. The BOP subsea control and telemetry system is used both to collect data from the wireless telemetry system and to control operation of the blowout preventer system. In this example, the BOP subsea control and telemetry system is used to both receive control signals from a surface system and to relay data to the surface system through a common umbilical.

The overall well system structure reduces the expense and complexity of the system by using the BOP subsea control and telemetry system for both BOP system control and data transfer from the downhole telemetry system, e.g. downhole wireless telemetry system. Consequently, the downhole telemetry system may be operated without its own dedicated cable for communication between the seabed and the surface. Routing a separate cable for the telemetry system down along a tubing string can be expensive, difficult, and time-consuming. By interfacing the BOP subsea control and telemetry system with surface control via a common umbilical, the desired communication between the seabed and the surface is achieved with a simpler, less expensive system.

The downhole telemetry system may comprise various types of systems depending on the parameters of a given application. In some applications, the downhole telemetry system may be in the form of a wireless telemetry system such as an acoustic or electromagnetic wireless telemetry system. Additionally, the wireless telemetry system may comprise a plurality of repeaters positioned within a borehole, e.g. along a tubing string. The repeaters may each comprise equipment that can both receive and transmit messages wirelessly. For example, a wireless repeater may comprise a sensor to receive a wireless signal, a transmitter to transmit the wireless signal, electronics to handle the receiving and transmitting of wireless messages, and a power source, e.g. a battery. The sensor and transmitter may be combined into a single component acting as a transceiver.

The wireless telemetry system is able to transmit the desired data by, for example, modulating a wireless signal. The method of modulation may involve the transmission of analog and/or digital information. For example, the modulation method may comprise AM, FM, PSK (phase-shift keying), FSK (frequency-shift keying), OFDM (orthogonal frequency-division multiplexing), or another suitable modulation method. Implementation of the specific modulation method may be managed by the electronics with respect to transmission and reception of the wireless signal. The wireless repeaters may be deployed downhole and may be arranged in a communication network. Additionally, a suitable network communication protocol be implemented for managing the communication between repeaters. Depending on the implementation, the telemetry may be one way telemetry, half duplex telemetry, or full duplex telemetry.

Additionally, the wireless telemetry system may comprise a series of devices interfaced with the repeaters which may be used for producing data of interest for the user or enabling remote control of their operation. The interfaces between the devices and the repeaters may be constructed to allow data acquisition from the device and/or control of the device through the wireless communication system.

In well applications, the repeaters of the wireless telemetry system may be deployed downhole via a suitable conveyance, e.g. a pipe. For example, the suitable conveyance may comprise pipe components in a well string, including pipes used for production, for pumping downhole, for drilling, or for other well related activities. The pipe may comprise production tubing, coiled tubing, casing, drill pipe, and/or other suitable tubular components. The repeaters of the wireless telemetry system may be clamped onto the pipe or coupled with the pipe via dedicated carriers connected into, e.g. threadably engaged into, the well string.

The wireless telemetry system also may comprise an acquisition and control system which may be used to communicate with remote devices. For example, the acquisition and control system may be used to control the remote devices and/or to acquire data from the remote devices. The control and acquisition system also may provide an interface between the user and the telemetry data while also providing the ability for a user to operate the telemetry system. The actual implementation of the control and acquisition system can vary depending on the application, but an example comprises a processor-based computer system. The processor-based computer system may utilize software for interfacing with the repeaters of the wireless telemetry system and for using the repeaters as an entry point to the communication network.

If the wireless telemetry system is in the form of an acoustic system, the wireless signal comprises an acoustic signal. The acoustic signal travels along the borehole, e.g. along a structure deployed in the borehole. Acoustic signals may be propagated through fluid, e.g. gas or liquid, or through solids, e.g. metallic structures, rock structures, or organic structures. The pipes, e.g. tubular components, of a well string may be used for carrying the acoustic signals and often provide a good wave guide for the acoustic signal. The acoustic signals also are able to travel through a variety of complex mechanical structures associated with the well string, e.g. mechanical structures in a bottom hole assembly. Acoustic signals may be generated in downhole conditions by various acoustic signal generators, such as piezo electrical transducers, used as transceiver assemblies to both receive and transmit the wireless signal.

Other wireless signals also may be employed for propagating information along the borehole. For example, the wireless telemetry system may comprise an electro-magnetic communication system using electro-magnetic signals. In such an application, a wireless signal may be in the form of a current injected into the formation. An example of an electro-magnetic telemetry system is the JADE™ Telemetry System available from Schlumberger Corporation.

An example of an acoustic wireless telemetry system is the Muzic™ Wireless Telemetry system available from Schlumberger Corporation. This type of wireless acoustic telemetry system is based on a backbone network of repeaters that can be interfaced with many types of downhole equipment. For example, the acoustic wireless telemetry system may comprise repeaters connected with test valves, pressure gauges, fluid samplers, firing heads, and a variety of other devices which may be used downhole.

As described in greater detail below, various wireless telemetry systems may be used to relay data, e.g. sensor data, wirelessly from a downhole location to a repeater or other suitable device located at a seabed location. The seabed repeater/device may be coupled with a BOP subsea control and telemetry system to enable transmission of the data to a surface control via the umbilical or other common communication line. Various types of information, such as sensor data or control signals, may be carried by a wireless signal, e.g. an acoustic signal, transmitted along a tubing string, e.g. a drill string, completion string, or other well string. For example, the tubing string may be deployed at least partially within a wellbore and may comprise a plurality of wireless acoustic repeaters which receive and then transmit the acoustic signal along the tubing string. The acoustic signal may embody data from, for example, a sensor or a plurality of sensors deployed downhole in the wellbore to monitor pressure data, temperature data, and/or other downhole data. The acoustic signal is received at each repeater and then the acoustic signal is transmitted to the next sequential repeater at a desired frequency and bit rate. An example of this type of acoustic system is described in US Patent No. 8,994,550, assigned to Schlumberger Technology Corporation.

The wireless telemetry system may effectively comprise a network of nodes in the form of repeaters attached, e.g. clamped, to the production pipe or other tubing string components. Each repeater can receive and send acoustic messages. The acoustic messages generated are relayed from one node to another until reaching their final destination. The repeaters also may be configured differently depending on their specific role and on their location along the tubing string. The repeaters may be standalone repeaters or they can be interfaced with downhole equipment. Furthermore, the wireless telemetry system may be constructed to interface with various devices via a digital interface. Downhole repeaters and surface repeaters may be used at various positions along the tubing string and may comprise a surface repeater, e.g. an uppermost repeater, which is connected to a wireless acquisition front-end of the acoustic network and to a dedicated computer used to control and monitor downhole equipment.

In various embodiments, the wireless telemetry system is combined with a blowout preventer system in the form of an electrohydraulic system comprising several specialized valves (often called a BOP) stacked together. The valves enable the controlling and sealing of a subsurface well in case of uncontrolled release of subsurface fluid. The BOP may be used in an early phase of well construction (e.g. drilling, casing, cementing) before a production Christmas tree is installed.

The BOP (or BOPs) also may be very useful in the context of a well test in which the well is produced with a temporary subsurface to surface production system. In this context, the BOP is acting as a safety barrier in case control of the well is lost. Blowout preventer systems are constructed to provide control over the well in the presence of tubing and cable, e.g. in the presence of a drill string, a production pipe, coiled tubing, hydraulic lines, wireline, and/or other equipment. In general, a BOP system may be composed of several BOPs which each have a specific function. Examples of BOPs include a RAM BOP, having a pipe ram and a blind and shear ram, and an annular RAM.

In the context of a subsea operation, embodiments of the BOP system may comprise equipment such as a lower BOP stack, a lower marine riser package (LMRP), an electrohydraulic umbilical, and a control system. The lower BOP stack may be attached to a wellhead through a wellhead connector and may comprise blind rams and annular rams stacked on top of each other. The configuration of the lower BOP stack may be specifically selected for each BOP system and may vary from one application to another. The lower BOP stack provides control over the well in case of an emergency, e.g. control over a subsurface flow either by sealing the well annulus or by cutting and sealing a production pipe.

According to certain embodiments, the LMRP may be constructed from an additional stack of BOPs, e.g. annular BOPs. The LMRP provides an interface with a riser extending upwardly and connecting with a surface rig. The interface comprises, for example, a knuckle joint and an in riser adapter. The lower BOP stack and the LMRP may be connected through a BOP latch which allows disconnection of the two structures. For example, the LMRP may be disconnected from the lower BOP stack during the course of a maintenance operation or an emergency. Once the LMRP is disconnected, the rig recovers its freedom of movement and thus the LMRP disconnection also may be triggered in the case of bad weather.

As described in greater detail below, the operation of the BOP system from the surface may be facilitated by an electrohydraulic umbilical. The electrohydraulic umbilical may be constructed with a bundle of hydraulic hoses and cables. The hydraulic hoses may be used to provide hydraulic power to the seabed so as to enable actuation of the various BOP rams. The cables may be in the form of electrical and/or optical cables used for communication with the surface as well as providing electrical power to the seabed. The communication may be bi-directional from seabed to surface and from surface to seabed. The control system also is coupled with the electrical and/or optical cables and may comprise a surface control system and a seabed control system coupled via the umbilical. As described herein, the umbilical may be used to carry signals with respect to both the BOP system and the subsea wireless telemetry system.

Various embodiments described herein are useful in well test applications involving a subsea landing string in a subsea environment. A well test is an operation in which a temporary set of equipment at the surface and downhole is deployed to set a well in production while monitoring certain parameters. In a subsea environment, the well test is enabled by deploying a subsea landing string which has safety equipment coupled to a production pipe to control the production flow in case of emergency and to allow disconnection of the production pipe while stopping the flow.

Examples of landing strings which may be used with embodiments of the BOP subsea control and telemetry system are illustrated in, for example, FIGS. 1-5 and may comprise various components. For example, the landing string may comprise a flow control valve, e.g. a ball valve, used to control flow along the landing string. The landing string also may comprise a latch which allows disconnection of the production pipe in case of an emergency. Additionally, the landing string may comprise a retainer valve which is an optional component located above the latch for controlling flow in an upper section of the tubing of the landing string.

The retainer valve closes in case of disconnection at the latch and prevents liquid spill if the latch is disconnected.

The retainer valve and the latch may be connected through, for example, a shear sub extension, e.g. a pipe that may be sheared via a shear ram BOP. In some embodiments, there may be a plurality of shear ram BOPs stack together, and the shear sub extension is constructed with a corresponding space out. The landing string also may comprise other equipment, such as a spanner joint, a quick union, a control system, and/or other equipment selected according to the parameters of a given well test operation.

The BOP system and the subsea landing string are operated concurrently in case of an emergency. The BOP system enables disconnection of the riser, and the subsea landing string is constructed to allow disconnection of the production pipe. Each system includes a flow control device that may be operated to control flow from the well and also flow within the production pipe. The subsea landing string is deployed down into the lower BOP stack. As described in greater detail below, the BOP subsea control and telemetry system enables operation and control of both the BOP system and components of the landing string via a single, common umbilical to eliminate risk associated with use a separate cable deployed for the subsea landing string.

Referring generally to FIG. 1, an example of a subsea well system 20 is illustrated in which embodiments described herein may be employed. The subsea well system 20 comprises a blowout preventer (BOP) system 22 positioned proximate a seabed 24 and over a wellbore 26 drilled into a subsea formation 28. It should be noted BOP system 22 may be used in cooperation with a variety of other types of subsea equipment such as a wellhead. A BOP subsea control and telemetry system 30 is located at a subsea position proximate the BOP system 22 and is used, in part, to control functions of the blowout preventer system 22. Depending on the application, the BOP subsea control and telemetry system 30 may comprise a fully integrated system or may comprise separate systems to handle, for example, communication from seabed to surface or for control and acquisition of downhole wireless telemetry. In the example illustrated, the BOP subsea control and telemetry system 30 is mounted to the BOP system 22.

The subsea well system 20 further comprises a wireless telemetry system 32 having a plurality of wireless repeaters 34, e.g. wireless acoustic repeaters, positioned along a tubing string 36 (e.g. a tubing string comprising production tubing) extending down into wellbore 26. At least some of the repeaters 34 are positioned downhole in wellbore 26 along the production tubing/tubing string 36. The wireless telemetry system 32 further comprises a separate repeater 38, e.g. a BOP mounted repeater, located externally of the tubing string 36. The external repeater 38 is coupled in communication with the BOP subsea control and telemetry system 30 via, for example, a wired interface 40. In some applications, a plurality of repeaters 38 may be used to provide redundancy.

The BOP subsea control and telemetry system 30 receives telemetry data from the wireless telemetry system 32 and processes and/or relays the telemetry data to a surface control system 42. In some embodiments, the BOP subsea control and telemetry system 30 comprises a processor system able to process and relay telemetry data from the wireless telemetry system 32 to surface control system 42 while also processing and relaying control signals from surface control system 42 to BOP system 22. Depending on the application, the surface control system 42 may comprise a combined BOP surface control and acquisition system 44 and wireless telemetry control and acquisition system 46. The combined systems 44, 46 may be used to send and/or receive signals with respect to the BOP system 22 and wireless telemetry system 32, respectively.

The surface control system 42 may be communicatively coupled with BOP subsea control and telemetry system 30 via a suitable communication line 48. By way of example, the communication line 48 may be in the form of an umbilical 50 which is able to provide electrical signals to and from the BOP subsea control and telemetry system 30. The umbilical 50 can be used to carry control signals, e.g. commands, from surface control system 42 to subsea system 30 for controlling BOP operation. In some applications, control signals also may be supplied to the wireless telemetry system 32. Additionally, the umbilical 50 can be used to carry data signals from the wireless telemetry system 32 and BOP system 22 via transmission from BOP subsea control and telemetry system 30 to the surface control system 42. In some applications, the umbilical 50 also may comprise hydraulic control lines for supplying hydraulic control fluid to, for example, system 30 and BOP system 22. Additionally, some embodiments may utilize redundant communication lines within the umbilical 50 or plural umbilicals 50 to provide the desired redundancy. The umbilical 50 also may utilize different control lines for different functions. For example, a communication line or lines within the umbilical 50 may be dedicated to safety control functions, while separate communication lines may be used for monitoring functions, telemetry functions, and/or other functions.

Depending on the application, the tubing string 36 may have a variety of configurations. For example, the tubing string 36 may be in the form of a test string, drill string, completion string, or other suitable well string for use in a subsea application. The tubing string 36 extends down through an internal passage 52 of BOP system 22 and into wellbore 26. In some applications, a riser 54 extends upwardly toward a sea surface 56 and tubing string 36 is deployed down through the riser 54 and through BOP system 22 into wellbore 26. Tubing string 36 also may comprise an upper tubing string 58 coupled with a lower tubing string 60 via, for example, a latch assembly 62. A shear sub 63 may be positioned above the latch assembly 62 or at another suitable location (see, for example, FIG. 2).

The tubing string 36 may be deployed from a suitable surface structure located at sea surface 56. By way of example, the surface structure may comprise a rig and may be in the form of a platform or vessel. The surface control system 42 may be located in whole or in part at surface 56 on, for example, the surface structure.

The wireless telemetry system 32 may comprise a variety of wireless systems for communicating data between repeaters 34. For example, signals may be transmitted electromagnetically or acoustically from one wireless repeater 34 to the next. The uppermost repeater 34 may be used to communicate with BOP mounted repeater 38 so that data may be relayed to a location external to tubing string 36 and then to BOP subsea control and telemetry system 30 via interface 40. In the example illustrated, interface 40 is a wired interface but various wireless interfaces also may be employed to transmit data between repeater 38 and subsea system 30. Similarly, an interface 64 may be used to transmit signals between at least one of the repeaters 34, e.g. the uppermost repeater 34, and repeater 38. The interface 64 may be in the form of a wireless interface using, for example, acoustic or electromagnetic transmission of signals.

According to one embodiment, the wireless telemetry system 32 is in the form of a wireless acoustic telemetry system, such as the Muzic™ Wireless Telemetry system discussed above and available from Schlumberger Corporation. This type of wireless acoustic telemetry system 32 may be operated by transmitting acoustic signals along tubing string 36. The wireless repeaters 34 may be in the form of acoustic repeaters coupled, e.g. clamped, to tubing string 36. The wireless acoustic repeaters 34 are able to receive acoustic signals traveling along tubing string 36 and to relay those acoustic signals to the next sequential repeater 34. This process is repeated until the data can be transmitted externally to repeater 38 (mounted externally of tubing string 36) and then to BOP subsea control and telemetry system 30. In some applications, wireless interface 64 may be in the form of an acoustic interface using acoustic signals transferred through structural materials and/or fluid between at least one of the repeaters 34 and external repeater 38. The data may then be relayed via umbilical 50 to, for example, surface control system 42.

The wireless telemetry system 32 may be used to transmit a variety of data from a downhole location. For example, the wireless telemetry system 32 may be coupled with a plurality of sensors 66, e.g. pressure sensors and temperature sensors, monitoring desired downhole parameters. The data may be collected by sensors 66 in a variety of applications. For example, sensors 66 and wireless telemetry system 32 may be used with various landing strings, production pipe, test strings, completion strings, drill strings, or other suitable tubing strings 36. In some applications, the wireless telemetry system 32 may be used bi-directionally to also enable communication of signals, e.g. control signals, to various devices, e.g. landing string devices, located in wellbore 26.

Figure 2:
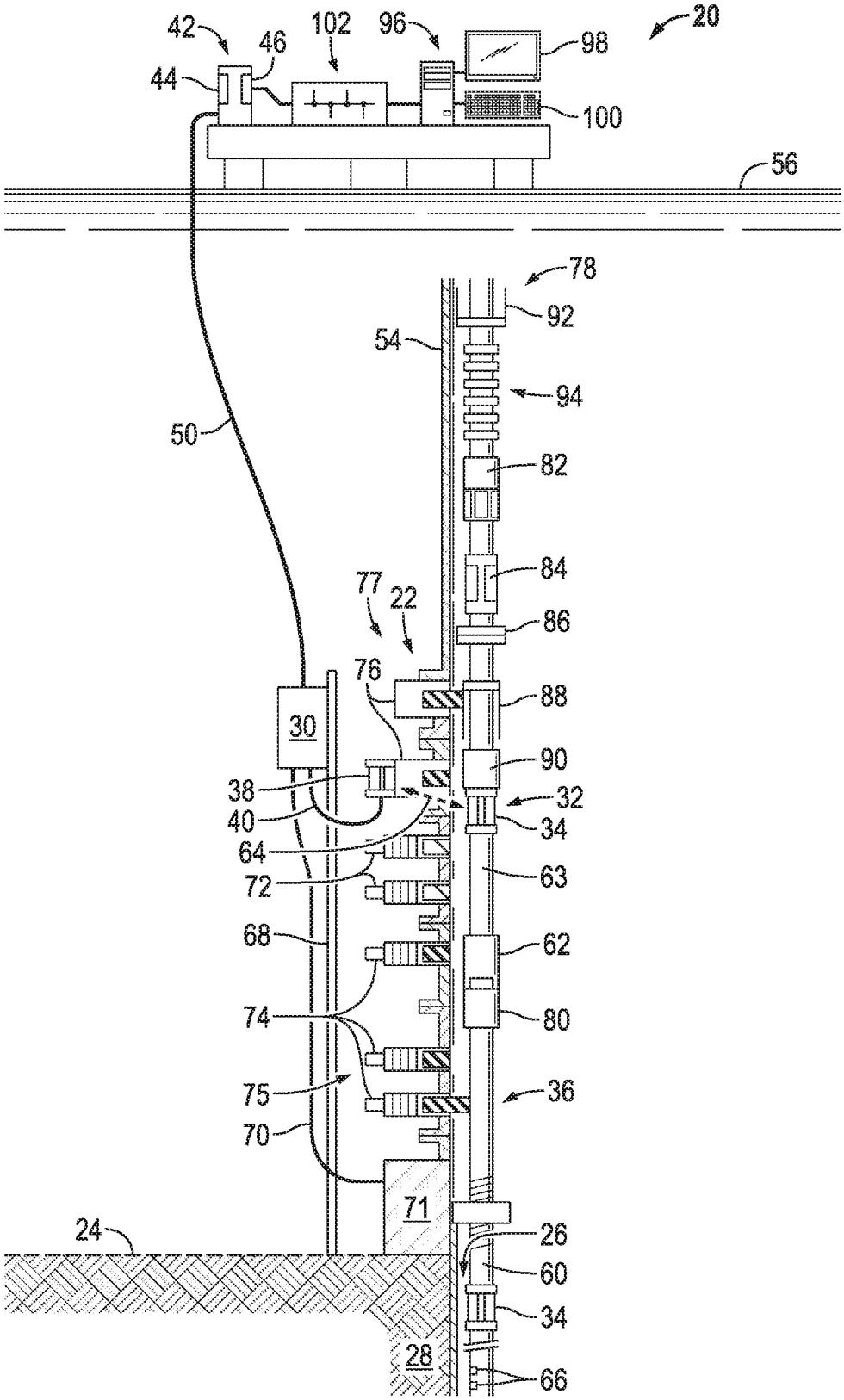
FIG. 2 is a schematic illustration of another example of a subsea well system having a blowout preventer system and a wireless telemetry system, according to an embodiment of the disclosure.

Referring generally to FIG. 2, another embodiment of subsea well system 20 is illustrated. In this example, BOP subsea control and telemetry system 30 is again mounted proximate BOP system 22 on, for example, a suitable mounting structure 68. System 30 may be operatively coupled with wireless telemetry system 32 via wired interface 40 and with BOP system 22 via a suitable communication interface 70 which may comprise hydraulic and/or electrical control lines. In some applications, the interfaces 40, 70 may be combined in an integrated system.

According to an embodiment, the external repeater 38 may be mounted to BOP system 22 at an upper end of the BOP system 22 for communication with the uppermost repeater 34, e.g. acoustic repeater, via wireless interface 64. The uppermost repeater 34 is mounted above seabed 24 along tubing string 36. In this embodiment and other embodiments described herein, the repeater 38 may be a BOP mounted repeater and mechanically coupled along an outside of the BOP system 22. However, the external repeater 38 also may be embedded or otherwise mounted within the structure of BOP system 22 and communicatively coupled with, for example, uppermost repeater 34.

Depending on the parameters of a given application, blowout preventer system 22 may be coupled with a wellhead 71 via a suitable wellhead connector. The blowout preventer system 22 also may comprise a variety of components, including components functionally controlled via BOP subsea control and telemetry system 30. By way of example, BOP system 22 may comprise a plurality of rams, such as a plurality of shear rams 72 and a plurality of pipe rams 74 which form a lower BOP stack 75. The rams utilized in lower BOP stack 75 are sometimes in the form of blind rams and annular rams.

The BOP system 22 also may comprise various other features, such as additional sealing and/or closure components 76 located in a lower marine riser package (LMRP) 77. By way of example, the sealing and/or closure components 76 may be in the form of annular BOP rams. The LMRP 77 may be coupled with the lower BOP stack 75 via a suitable connector, such as a BOP latch. Additionally, The LMRP 77 provides an interface with riser 54 which may extend upwardly for connection with a surface rig. The interface comprises, for example, a knuckle joint and an in riser adapter.

The repeater 38 may be mounted at various positions along BOP system 22 selected to enable dependable communication with repeater 34. In the illustrated example, the repeater 38 is located at a position above the rams 72, 74. However, the repeater 38 may be mounted at other positions along and/or within BOP system 22, as described in greater detail below.

Similarly, tubing string 36 may comprise a variety of cooperating strings and components. In the example illustrated, tubing string 36 comprises a landing string 78 which may be in the form of a test string. However, tubing string 36 also may comprise other types of tubing strings. In the specific example illustrated, the tubing string 36 is a test string comprising upper tubing section 58 engaged with lower tubing string 60 via latch assembly 62. In this example, the uppermost repeater 34 is located along tubing string 36 above latch assembly 62.

Examples of other tubing string features comprise a flow valve 80 located below latch assembly 62 and positioned to enable selective blockage of flow along the lower tubing string 60. The landing string 78 may comprise many types of components to facilitate a given testing application or other application. In the embodiment illustrated, the landing string 78 comprises additional components, such as a deep water control system 82, a pressure and temperature system carrier 84, a quick union 86, a spanner joint 88, and a retainer valve 90. In some applications, the landing string 78 also may comprise a junk basket 92 located within riser 54 above various other components. If the wireless telemetry system 32 is in the form of a wireless acoustic telemetry system transmitting acoustic signals along tubing string 36, an acoustic filter 94 may be located along tubing string 36 to filter out undesirable acoustic noise.

In the embodiment illustrated, the surface control system 42 comprises or may be coupled with an input/output device 96, such as a computer. The computer 96 may be a personal computer or other suitable computer for displaying processed data received from wireless telemetry system 32. For example, the computer 96 may comprise a display screen 98 for displaying downhole data collected from, for example, sensors 66 and relayed to the surface via wireless telemetry system 32, BOP subsea control and telemetry system 30, and umbilical 50.

The computer 96 also may comprise an input device 100, e.g. a keyboard, for providing control commands which may be relayed down to the BOP 22 and/or wireless telemetry system 32. In the example illustrated, the computer 96 is coupled with surface control system 42 via an appropriate network 102 such as a wired and/or wireless network. Depending on the application, the computer 96 may be located on-site with surface control system 42; or network 102 may be used to enable utilization of computer 96 from a remote location.

Figure 3:
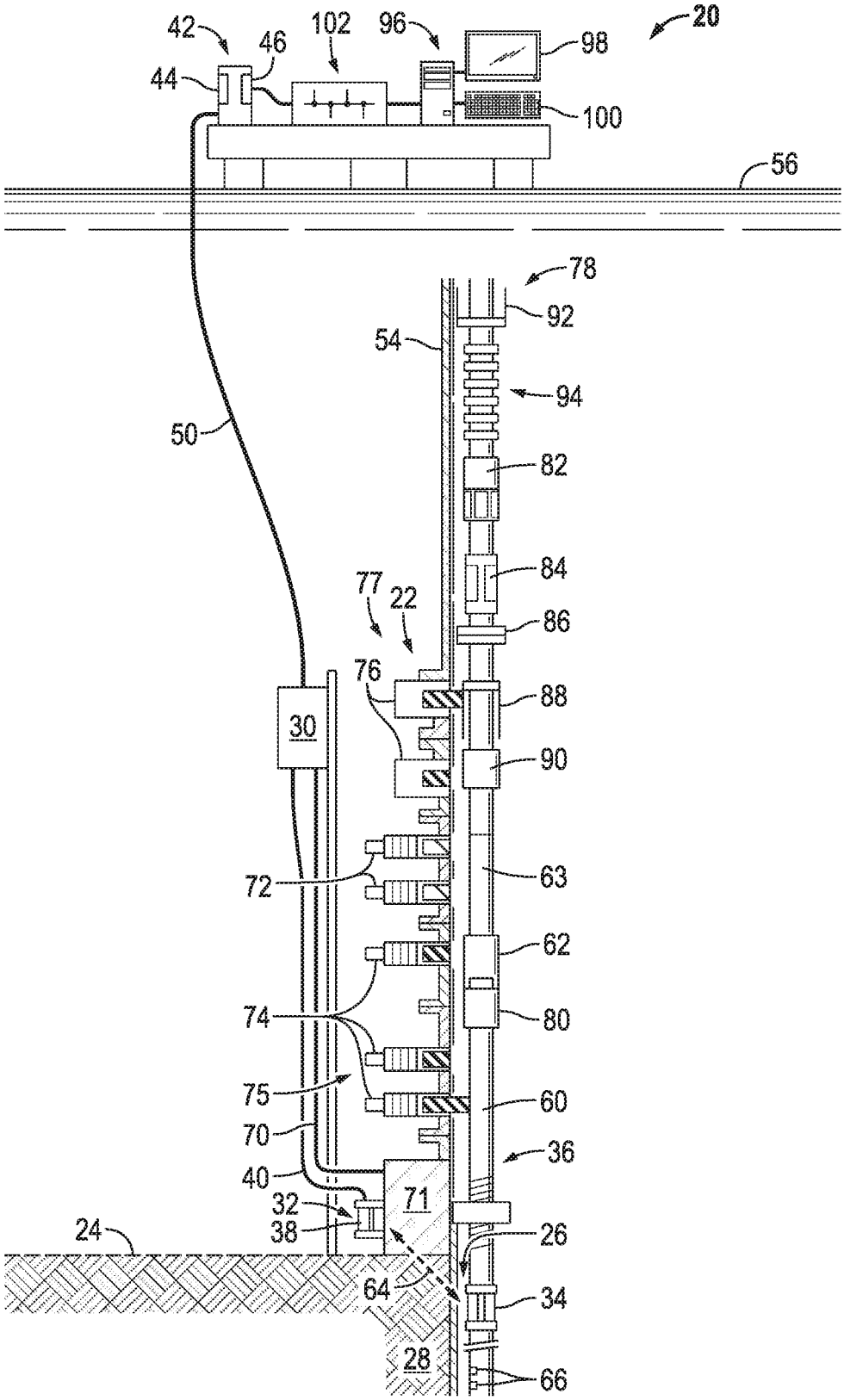
FIG. 3 is a schematic illustration of another example of a subsea well system having a blowout preventer system and a wireless telemetry system, according to an embodiment of the disclosure.

Referring generally to FIG. 3, another embodiment of subsea well system 20 is illustrated. This latter embodiment has certain components common to the embodiment described above and illustrated in FIG. 2. However, the uppermost repeater 34 is located below latch assembly 62 and below seabed 24 within wellbore 26. The BOP mounted repeater 38 is positioned closer to seabed 24 at a lower end of BOP system 22 to enable communication between the uppermost repeater 34 and external repeater 38 via wireless interface 64. As with the embodiment illustrated in FIG. 2, the various illustrated BOP components, tubing string sections, and tubing string components may be adjusted or changed according to the parameters of a given subsea well operation.

Depending on the embodiment, the surface control system 42 may be constructed such that the wireless telemetry and control system 46 is embedded within the BOP surface control and acquisition system 44 or the systems can be operated separately in parallel with separate dedicated hardware and software infrastructure. The level of integration and infrastructure sharing between the control systems 44, 46 may vary depending on the parameters of a given application. In a variety of subsea operations, the umbilical 50 and certain control systems, e.g. BOP surface control and acquisition system 44, may be constructed as redundant systems. A similar approach may be used for the external BOP repeater 38. For example, multiple repeaters 38 may be deployed on the BOP system 22 and may be redundantly coupled with multiple communication paths available within the single, common umbilical 50.

Figure 4:
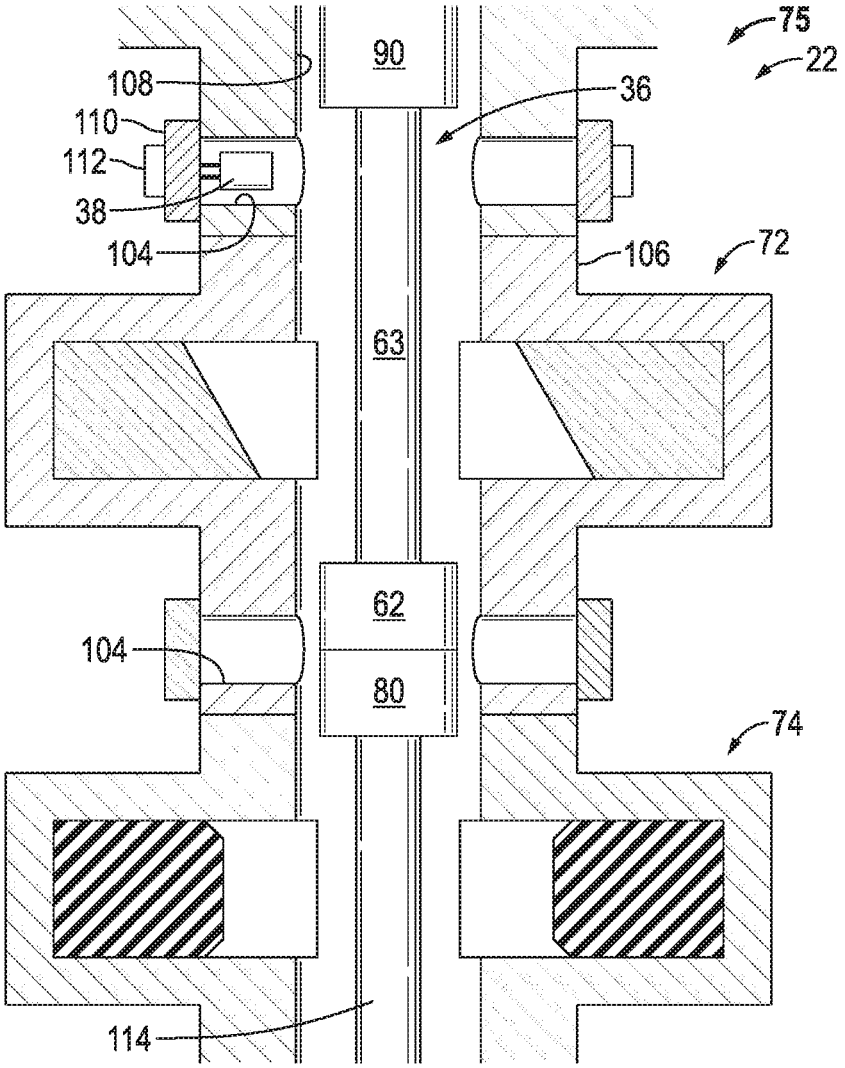
FIG. 4 is a schematic illustration of a portion of an example of a blowout preventer system having a repeater employed in a wireless telemetry system, according to an embodiment of the disclosure.
Figure 5:
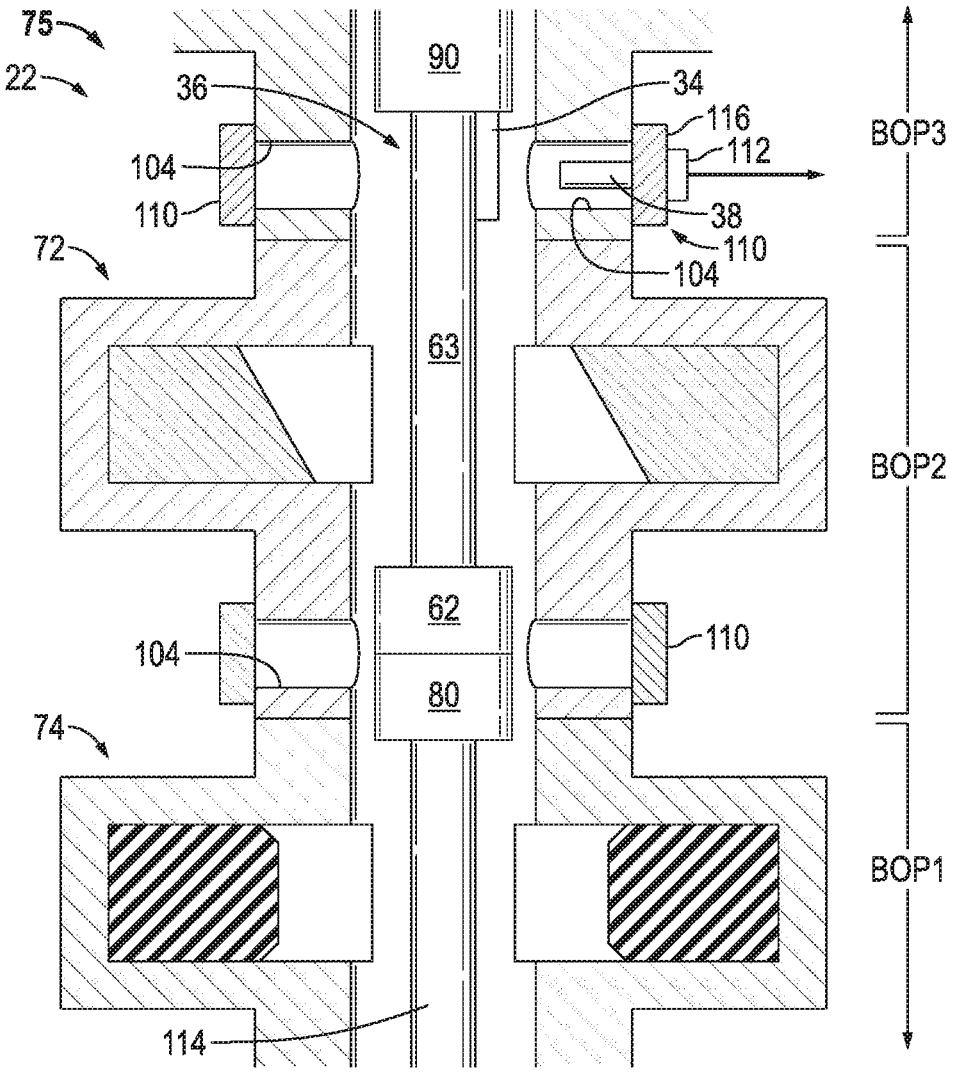
FIG. 5 is a schematic illustration of a portion of another example of a blowout preventer system having a repeater employed in a wireless telemetry system, according to an embodiment of the disclosure.

Referring generally to FIGS. 4 and 5, additional embodiments are illustrated in which components of the integrated control system, e.g. repeater 38, may be more integrated into the BOP system 22. Referring initially to FIG. 4, an embodiment is illustrated in which at least one repeater 38 is positioned in a service hole 104 located in a body structure 106 of BOP system 22. The service hole or holes 104 may be formed through body structure 106 to provide access to the open interior 108 of BOP system 22. Depending on the application, the service hole(s) 104 may be used to deploy pressure temperature sensors for monitoring parameters within the BOP system 22. The service holes 104 also may be connected to BOP kill lines and may be used to inject kill fluid during certain operations. In the illustrated example, the repeater 38 is integrated into the BOP system 22 via placement within a corresponding service hole 104. An appropriate cap structure 110, e.g. a flange, may be placed over the corresponding service hole 104 to enclose repeater 38 therein.

In the example illustrated, the repeater 38 is operatively coupled, e.g. electronically connected, with corresponding electronics 112. The electronics 112 are part of or work in cooperation with interface 40 to enable communication with the BOP subsea control and telemetry system 30. In some applications, redundancy may be provided by positioning a plurality of repeaters 38 in a plurality of service holes 104. As with other embodiments, the repeater or repeaters 38 may have a variety of structures. An example is an acoustic repeater, such as an acoustic repeater used with the Muzic™ Wireless Telemetry system available from Schlumberger Corporation.

Depending on the application, the repeater 38 may be integrated into body structure 106 and thus placed in direct contact with the open interior passage 108 of BOP system 22. The close placement to interior 108 facilitates communication with, for example, the uppermost repeater 34 disposed along tubing string 36. Placement of the uppermost repeater 34 may be selected based on the location of the service hole 104 which receives the repeater 38. In the embodiment illustrated, the tubing string 36 comprises retainer valve 90 coupled with latch assembly 62 via shear sub extension 63. The valve 80 may be positioned beneath latch assembly 62 and coupled with, for example, a slick joint 114. When tubing string 36, e.g. a subsea test string, is positioned within BOP system 22, the shear sub extension 63 may be located within at least one shear ram 72 and slick joint 114 may be located within at least one pipe ram 74. Consequently, the uppermost repeater 34 may be attached to the shear sub extension 63 or to another suitable component proximate repeater 38 once tubing string 36 is received in BOP system 22.

Another embodiment is illustrated in FIG. 5 and shows repeater 38 positioned proximate repeater 34 which is clamped to the adjacent shear sub extension 63. For example, the uppermost repeater 34 may be mounted just below retainer valve 90 and may be conveyed via the shear sub extension 63. In this example, cap structure 110 is in the form of a specially constructed flange 116 which is able to seal the corresponding service hole 104. Flange 116 also may incorporate electronics 112 to enable electrical communication from the repeater 38 located in the corresponding service hole 104 to an external location and to the BOP subsea control and telemetry system 30.

Positioning the repeater 38 in one of the service holes 104 facilitates placement of the repeater 38 in close proximity with the corresponding repeater 34, e.g. the uppermost repeater 34 located along tubing string 36. The heavy mass of the BOP system 22 can provide multiple acoustic paths and can generate substantial attenuation and distortion. By locating the repeaters 38, 34 within a short distance, the robustness of the communication is enhanced by reducing the attenuation and distortion. It should be noted the repeater 38 may be integrated into other ports, components, or specially designed structures of BOP system 22 so as to move the repeater 38 into close proximity with the corresponding repeater 34.

Figure 6:
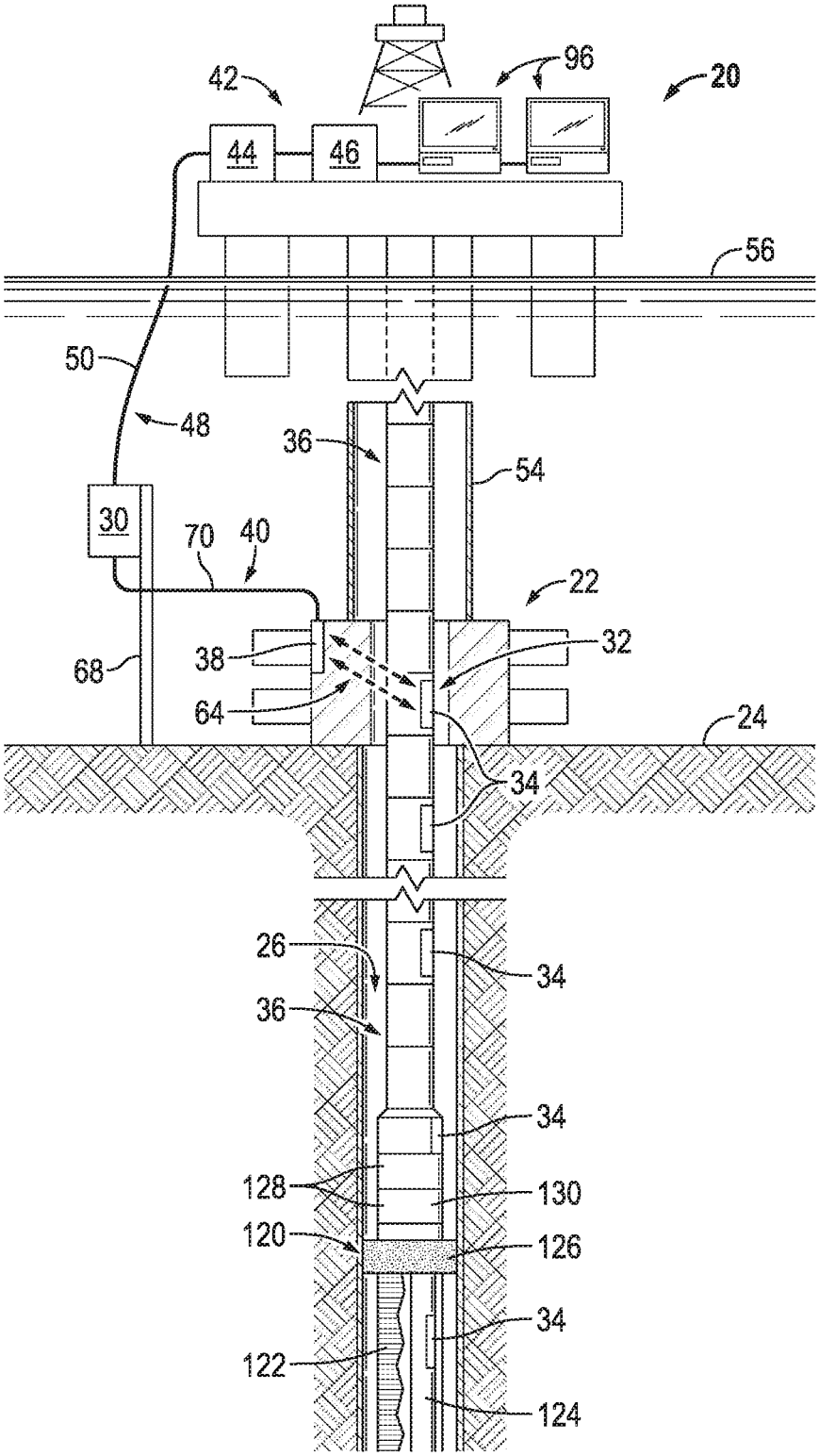
FIG. 6 is a schematic illustration of another example of a subsea well system having a blowout preventer system and a wireless telemetry system, according to an embodiment of the disclosure.

Referring generally to FIG. 6, another embodiment of subsea well system 20 is illustrated. In this example, BOP subsea control and telemetry system 30 is again mounted proximate BOP system 22 on, for example, the mounting structure 68. System 30 may be operatively coupled with wireless telemetry system 32 and with BOP system 22 via suitable communication interfaces, e.g. interfaces 40, 70 as described above. In this embodiment, the BOP subsea control and telemetry system 30 is implemented in a downhole completions application.

For completions applications, a lower completion 120 may be run downhole on, for example, drill pipe to a setting position. The wireless telemetry system 32, e.g. acoustic wireless telemetry system, may be used to provide real-time data during installation. The repeaters 34 may be deployed at appropriate locations along the tubing string 36 including, for example, along the lower completion 120.

According to this embodiment, the external repeater 38 may be mounted to BOP system 22, e.g. within or along BOP system 22, for communication with the uppermost repeater 34 via wireless interface 64. The uppermost repeater 34 may be mounted above seabed 24 along tubing string 36. In this embodiment and other embodiments described herein, the repeater 38 may be a BOP mounted repeater and mechanically coupled along an outside of the BOP system 22. However, the external repeater 38 also may be embedded or otherwise mounted within the structure of BOP system 22 and communicatively coupled with repeater 34.

Referring again to FIG. 6, the lower completion 120 of tubing string 36 may comprise a variety of sand control components. By way of example, the lower completion 120 may comprise screens 122, e.g. sand screens, and a wash pipe section 124 located below a packer 126. The lower completion 120 also may comprise or work in cooperation with components 128 disposed above packer 126, e.g. a service tool 130. One or more of the repeaters 34 may be located in the screens 122 and wash pipe section 124 and will be left in wellbore 26 at the end of the operation.

In this example, at least one of the repeaters 34 is located just above the packer 126 at, for example, service tool 130 so as to: obtain data from the lower completion 120; obtain data from service tool 130; and/or provide instructions to service tool 130. Additional repeaters 34 are located along the tubing string 36, e.g. drill string, up to the BOP system 22. The upper repeater 34 may be used to communicate wirelessly with BOP mounted repeater 38 as with embodiments described above.

Figure 7:
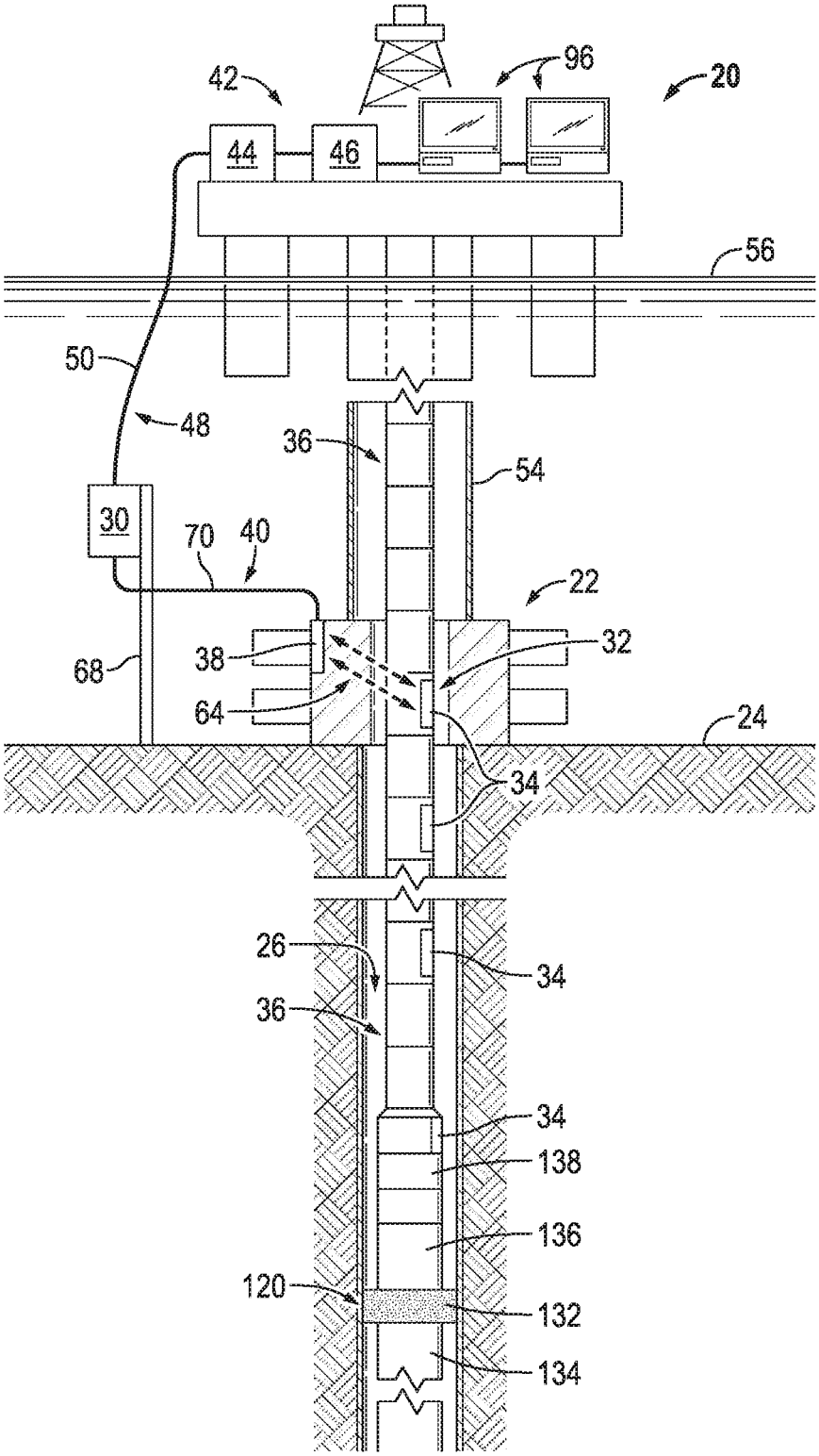
FIG. 7 is a schematic illustration of another example of a subsea well system having a blowout preventer system and a wireless telemetry system, according to an embodiment of the disclosure.

Referring generally to FIG. 7, another embodiment of subsea well system 20 is illustrated for use in a subsea liner hanger application. In this example, BOP subsea control and telemetry system 30 is again mounted proximate BOP system 22 on, for example, the mounting structure 68. System 30 may be operatively coupled with wireless telemetry system 32 and with BOP system 22 via suitable communication interfaces, e.g. interfaces 40, 70 as described above. In this embodiment, the BOP subsea control and telemetry system 30 is implemented in a downhole application utilizing a subsea liner hanger.

For this type of application, the lower completion portion may comprise a liner hanger 132 and corresponding liner string 134. The liner hanger 132 and liner string 134 may be run downhole on, for example, drill pipe to a desired wellbore location before setting the liner hanger 132. By way of example, the liner hanger 132 and liner string 134 may be run downhole via a liner hanger running tool 136. Some applications may utilize a measurement tool 138 disposed above the running tool 136.

In some embodiments, sensors and repeaters may not be deployed below the liner hanger, however other embodiments may utilize at least one sensor 66 and at least one repeater 34 at or beneath the liner hanger 132. Regardless, the repeaters 34 may be deployed at appropriate locations along the tubing string 36; and external repeater 38 may be mounted to BOP system 22 for communication with the uppermost repeater 34 via wireless interface 64. In this example, the uppermost repeater 34 may be mounted above seabed 24 along tubing string 36. As with other embodiments described herein, the repeater 38 may be a BOP mounted repeater and mechanically coupled along an outside of the BOP system 22. However, the external repeater 38 also may be embedded or otherwise mounted within the structure of BOP system 22 and communicatively coupled with repeater 34.

Some liner installation and cementing operations involve relatively large vertical displacement of the tubing string 36, e.g. drill string. Consequently, a plurality of repeaters 34, e.g. two repeaters 34, may be installed at suitable upper locations to facilitate interaction with the BOP system 22. The upper locations of the upper repeaters 34 are selected so that at least one of the repeaters 34 remains in close proximity to BOP system 22 during the installation and cementing operations. The close proximity minimizes acoustic impedance.

Figure 8:
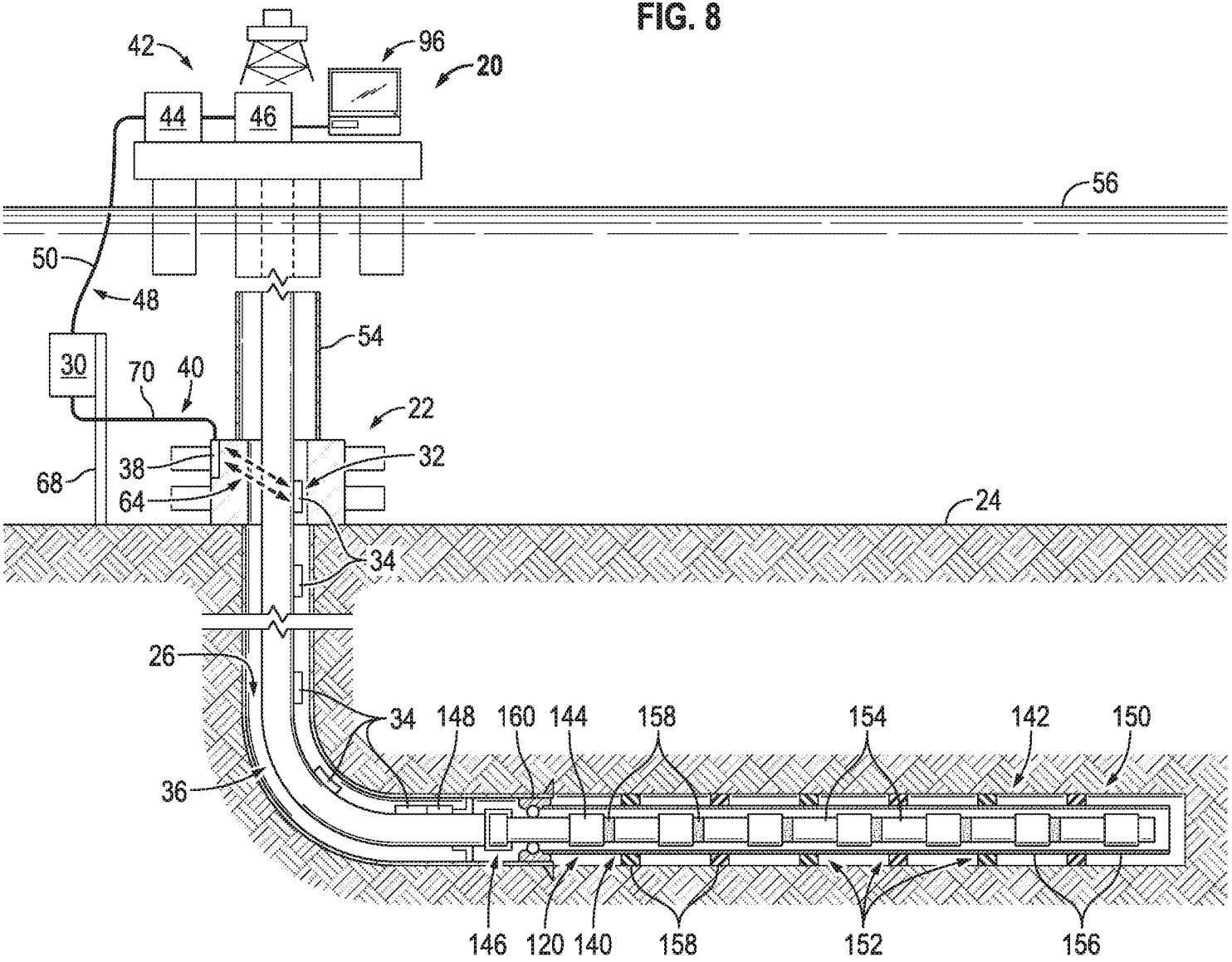
FIG. 8 is a schematic illustration of another example of a subsea well system having a blowout preventer system and a wireless telemetry system, according to an embodiment of the disclosure.

Referring generally to FIG. 8, another embodiment of subsea well system 20 is illustrated as comprising lower completion 120 in the form of an intelligent completion 140. In this example, BOP subsea control and telemetry system 30 is again mounted proximate BOP system 22 on, for example, the mounting structure 68. System 30 may be operatively coupled with wireless telemetry system 32 and with BOP system 22 via suitable communication interfaces, e.g. interfaces 40, 70 as described above. In this embodiment, the BOP subsea control and telemetry system 30 is implemented in an intelligent completion application in which intelligent completion 140 is located in, for example, a horizontal segment 142 of wellbore 26.

Similar to the other completions applications described herein, the intelligent completion 140 may be in the form of a lower completion run downhole and into horizontal wellbore segment 142 via a service tool. The intelligent completion 140 may be installed in the well permanently. By way of example, the intelligent completion 140 may comprise or may be coupled with an intelligent downhole tool 144 constructed to receive data from components of intelligent completion 140 and/or to provide control signals to components of intelligent completion 140. The intelligent downhole tool 144 may be placed in communication with wireless telemetry system 32 via, for example, an inductive coupling 146 and corresponding electronics 148, e.g. firmware, which provides data conversion for communication between the lower intelligent completion 140 and the wireless telemetry system 32.

As with other embodiments described herein, the wireless telemetry system 32 may comprise repeaters 34 deployed at appropriate locations along the tubing string 36. The external repeater 38 may again be mounted to BOP system 22 for communication with the uppermost repeater 34 via wireless interface 64. The uppermost repeater 34 may be mounted above seabed 24 along tubing string 36. In this embodiment and other embodiments described herein, the repeater 38 may be a BOP mounted repeater and mechanically coupled along an outside of the BOP system 22. However, the external repeater 38 also may be embedded or otherwise mounted within the structure of BOP system 22 and communicatively coupled with repeater 34.

Depending on the specifics of a given application, the lower/intelligent completion 140 may comprise many types of components deployed in a cased section of wellbore 26 or in an open hole section 150, as illustrated. Examples of completion components comprise screen assemblies 152 having corresponding base pipes 154 and screens 156, e.g. sand screens. Various packers 158, e.g. swell packers, may be positioned along the completion 140 to isolate desired well zones. In some applications, the sand screen assemblies 152 may be deployed downhole of a liner hanger 160. However, the intelligent completion 140 may comprise many types of components selected according to the parameters of a given downhole application.

The methodologies and systems described herein may be used in many types of subsea operations. The wireless telemetry system 32 may be used to convey signals acoustically along tubing string 36 (or via other wireless methods) from a variety of downhole sensors or other devices. In some applications, the wireless telemetry system 32 also may be used to carry signals, e.g. commands, to devices positioned downhole in wellbore 26. The use of BOP subsea control and telemetry system 30 for relaying signals with respect to both BOP system 22 and wireless telemetry system 32 substantially simplifies communication between the surface and subsea components in many types of applications. It should be noted the subsea control and telemetry system 30, as well as the wireless telemetry system 32, may be used in a variety of other borehole applications, including non-wellbore applications.

The tubing string 36 also may comprise a variety of components and configurations. Additionally, the tubing string 36 may be deployed in a variety of vertical and/or deviated, e.g. horizontal, wellbores. The sensors 66 also may be used in many types of testing and/or monitoring applications and may be deployed in desired well zones or at other desired positions along wellbore 26. The number and spacing of repeaters 34 also may be adjusted according to the parameters of a given environment and application. Similarly, the location of the uppermost repeater 34 and the external repeater 38 may be selected to ensure reliable communication via interface 64. The processing of data may be performed at a single location or at multiple locations along the overall subsea well system 20. Furthermore, the configuration of the subsea control and telemetry system 30 as well as the surface control and acquisition system 42 may vary depending on the characteristics of a given system and on the types of signals relayed to or from the surface.

Additionally, the BOP subsea control and telemetry system 30 may comprise a combination of systems. For example, telemetry used to transfer signals from seabed to surface may not be the same as the telemetry used to control the BOP system. Similarly, BOP systems may have multiple communication systems, e.g. one communication system dedicated to safety control functions and a separate communication system dedicated to non-safety control functions. However, the communication and telemetry may simply be handled via different communication lines/cables in the same umbilical 50. Accordingly, the communication infrastructure may comprise several distinct lines of communication through the single umbilical. Additionally, the single umbilical 50 may have redundant communication lines used in cooperation with, for example, redundant repeaters 38. Various applications may utilize a BOP subsea control and telemetry system 30 having distinct systems for BOP system control and for wireless control and acquisition while utilizing the same umbilical.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

The invention claimed is:

1. A system for use in a well application, comprising:

a blowout preventer system positioned proximate a seabed and over a wellbore;

a blowout preventer (BOP) subsea control and telemetry system located subsea proximate the blowout preventer to control functions of the blowout preventer system;

a wireless telemetry system having a plurality of wireless repeaters positioned along a tubing string extending down into the wellbore, the wireless telemetry system further comprising a BOP mounted wireless repeater located externally of the tubing string, the BOP mounted repeater being coupled with the BOP subsea control and telemetry system, wherein the BOP mounted wireless repeater communicates with at least one of the plurality of repeaters positioned along a tubing string via a wireless interface;

a surface control system comprising a blowout preventer surface control and acquisition system and a wireless telemetry control and acquisition system; and an umbilical coupling the surface control system and the BOP subsea control and telemetry system, the umbilical carrying signals for the blowout preventer system and the wireless telemetry system.

2. The system as recited in claim 1, wherein the wireless telemetry system comprises a wireless acoustic telemetry system.

3. The system as recited in claim 2, wherein the wireless acoustic telemetry system relays acoustic signals along the tubing string.

4. The system as recited in claim 1, wherein the wireless repeaters of the plurality of repeaters are disposed below the seabed along the tubing string.

5. The system as recited in claim 1, wherein the tubing string comprises a well test subsea landing string.

6. The system as recited in claim 1, wherein the tubing string comprises a completion string.

7. The system as recited in claim 1, wherein the BOP mounted wireless repeater is mounted on an exterior of the blowout preventer system.

8. The system as recited in claim 1, wherein the BOP mounted wireless repeater is integrated into a body structure of the blowout preventer system.

9. The system as recited in claim 1, wherein the BOP mounted wireless repeater is operatively coupled with the BOP subsea control and telemetry system via a wired interface.

10. A system, comprising:

a blowout preventer system deployed at a subsea location;

a well string deployed through the blowout preventer system and into a wellbore situated below the blowout preventer system;

a plurality of wireless repeaters disposed along the well string to relay acoustic signals along the well string;

an external wireless repeater disposed along the blowout preventer system, the external wireless repeater being in wireless communication with the plurality of repeaters; and a BOP subsea control and telemetry system in communication with both the blowout preventer system and the external wireless repeater, the external wireless repeater enabling communication of wireless signals along the well string.

11. The system as recited in claim 10, further comprising a surface control system comprising a blowout preventer surface control and acquisition system and a wireless telemetry control and acquisition system.

12. The system as recited in claim 11, further comprising an umbilical coupling the surface control system and the BOP subsea control and telemetry system, the umbilical carrying data and control signals for both the blowout preventer system and the external wireless repeater.

13. The system as recited in claim 10, wherein the plurality of wireless repeaters is operated to relay test data from a downhole well test application.

14. The system as recited in claim 10, wherein the plurality of wireless repeaters is operated to relay sensor data from a plurality of downhole sensors.

15. The system as recited in claim 10, wherein the blowout preventer system comprises a plurality of rams controlled by the BOP subsea control and telemetry system.

16. A method, comprising:

deploying a BOP subsea control and telemetry system to a subsea location proximate a wellbore;

coupling the BOP subsea control and telemetry system to both a blowout preventer and a wireless telemetry system having a plurality of wireless repeaters deployed along a tubing string extending down into the wellbore;

using the BOP subsea control and telemetry system to control operation of the blowout preventer and to collect downhole data from the wellbore via the wireless telemetry system; and further using the BOP subsea control and telemetry system to facilitate the conversion of signals received via an umbilical into wireless signals transmitted along the plurality of wireless repeaters of the wireless telemetry system.

17. The method as recited in claim 16, further comprising operatively connecting the BOP subsea control and telemetry system with a surface control.

18. The method as recited in claim 17, wherein operatively connecting comprises connecting the BOP subsea control and telemetry system with the surface control via redundant communication lines located within the umbilical.

19. The method as recited in claim 18, further comprising operating the wireless telemetry system to relay sensor data from a downhole location.

20. The method as recited in claim 19, wherein operating comprises relaying the sensor data acoustically along a tubing string and then to an external wireless repeater having an interface with the BOP subsea control and telemetry system.

* * * * *